US005413392A

United States Patent [19]

Schlack et al.

[11] Patent Number: 5,413,392

[45] Date of Patent: May 9, 1995

[54] PAWL ASSEMBLY

[75] Inventors: Richard E. Schlack, Rising Sun, Md.; David Milne, Lima, N.Y.

[73] Assignee: Southco, Inc., Concordville, Pa.

[21] Appl. No.: 43,260

[22] Filed: Apr. 6, 1993

[51] Int. Cl.[6] ..... E05C 3/04

[52] U.S. Cl. ..... 292/204; 70/379 R; 70/451; 411/349

[58] Field of Search ..... 292/202-204; 70/77-83, 123, 367, 370, 379-380, 451, 466; 24/590-596; 411/347, 349, 549-553

[56] References Cited

U.S. PATENT DOCUMENTS

| | | | |
|---|---|---|---|
| 2,852,926 | 9/1958 | Chervenka | 70/379 R X |
| 3,176,487 | 4/1965 | Dauenbaugh | 70/379 R X |
| 3,219,973 | 11/1965 | Lenz | 292/202 X |
| 3,877,268 | 4/1975 | Shull | 70/364 R |
| 3,936,673 | 2/1976 | Kelly et al. | 70/379 R X |
| 4,047,266 | 9/1977 | Bisbing | 24/221 R |
| 4,105,230 | 8/1978 | Amann et al. | 292/202 |
| 4,139,998 | 2/1979 | Jeavons et al. | 70/370 |
| 4,186,952 | 2/1980 | Glass | 292/202 |
| 4,213,230 | 7/1980 | Hoen | 24/217 R |
| 4,331,413 | 5/1982 | Hoen | 411/44 |
| 4,381,656 | 5/1983 | Hayakawa | 70/451 |
| 4,627,249 | 12/1986 | Dumortier | 292/204 X |
| 4,657,462 | 4/1987 | Hoen | 411/552 |
| 4,910,982 | 3/1990 | Dana | 70/451 X |
| 5,070,716 | 12/1991 | Whorlow | 70/380 X |
| 5,152,161 | 10/1992 | Lee | 70/379 R X |
| 5,251,467 | 10/1993 | Anderson | 70/451 X |
| 5,263,348 | 11/1993 | Wittwer | 70/379 R |
| 5,265,453 | 11/1993 | Konii et al. | 70/379 R |

FOREIGN PATENT DOCUMENTS

| | | | |
|---|---|---|---|
| 157870 | 7/1954 | Australia | 411/349 |
| 3102340 | 1/1981 | Germany . | |
| 0056982 | 9/1984 | Germany . | |
| 3316384 | 11/1984 | Germany . | |
| 4006707 | 9/1992 | Germany . | |
| 564108 | 9/1944 | United Kingdom | 411/349 |
| 2029889 | 3/1980 | United Kingdom . | |
| 2156893 | 10/1985 | United Kingdom . | |

OTHER PUBLICATIONS

EMKA Beschlagteile, Locks, Hinges and Gasketing, pp. B002-B003, B010, B020.

Dzus Handbook A17, (Dzus Fastener Co. 1989) pp. 83-85, 88-89.

*Primary Examiner*—Peter M. Cuomo
*Assistant Examiner*—Suzanne L. Dino
*Attorney, Agent, or Firm*—Paul and Paul

[57] ABSTRACT

A pawl assembly is adapted for being mounted in an aperture formed in a door panel for releasably retaining the door against a corresponding frame. The pawl assembly includes as portions thereof a housing which is received within the door panel aperture. The housing is formed having its distal end being conical in shape which allows a mounting nut to be mounted onto the pawl assembly when received in the door panel aperture. A drive member is included which is received within an axial bore formed in the housing and is adapted for rotational movement by an operator. A pawl is secured to the drive member in only one orientation of the pawl in relation to the drive member. The drive member rotation is limited by a protruding member which extends from the housing and into the drive member. The drive member is also included with a flange which is sized at least to completely cover the top of housing which provides a seal for restricting the passage of water, dust and other matter. A biasing member is also included which provides a frictional resistance upon the drive member on its rotational movement and also operates as a detent for releasably retaining the pawl assembly in its fully unlatched and fully latched positions.

51 Claims, 2 Drawing Sheets

PAWL ASSEMBLY

BACKGROUND OF THE INVENTION

1. Field of the Invention

The present invention relates generally to latching devices and more particularly to fasteners which are operable through rotation by a user for securing a door, panel or the like in a closed position relative to a corresponding frame.

2. Background of the Invention

Presently, there are a number of pawl assemblies known in the art which are operable by rotation of a shaft or the like for securing two panels or a panel against a corresponding frame. Generally, fasteners of this type include a latching pawl which is provided extending from a shaft disposed in the latch housing. In operation, rotation of the shaft corresponds with a movement of the latching pawl to its latched position. Generally, the fasteners of this type require varying degrees of rotation of the shaft for operation of the latch. One type are "quarter turn" fasteners which require a 90° rotation for operation of the latch. Such latches usually consist of a housing, drive stud, spring and pawl which are installed within an aperture formed in a door panel. However, one problem with such prior art designs is that water, dust and other matter is able to pass freely through the latch and into the interior compartment of the door panel, thus into contact with the contents contained therein. Another problem is that the spring which is positioned proximate the top of the latch between the drive stud and the housing is required during operation to support the load which is being applied by the latch. This increased stress applied by the latch adversely affects the springs operation and durability. Another draw back is that the installation of such latches can oftentimes be a rather time consuming and complicated process for some individuals. For instance, existing designs require that the installer correctly determine the proper orientation for the pawl on the shaft during installation. Furthermore, the designs which have been developed in order to hasten the installation process have proven to adversely affect latch operation. In particular, some designs allow a mounting nut to be slid over the pawl and onto the housing in order to accommodate installation within a panel aperture. However, these prior art designs require either a necked down section in the pawl, which reduces the strength of the pawl, or an extra loop in the pawl, which is rather difficult to manufacture.

The present invention has been developed in view of the foregoing and to overcome the deficiencies of the prior art.

SUMMARY OF THE INVENTION

The present invention provides a pawl assembly which is adapted to be mounted in an aperture formed in a door panel for releasably retaining the door against a corresponding frame. The pawl assembly of the present invention includes a housing which is adapted for being received within the door panel aperture. The housing is included with a substantially axial bore extending therethrough. A drive member is also included which has a substantially elongated shaft which is received within the housing bore for rotational movement. A biasing means is included which provides a frictional resistance to the drive member upon its rotation. A means for limiting the rotational movement of the drive member shaft is also included which is positioned between the housing and the drive member. A pawl means is also provided associated with the drive member shaft and adapted for rotational movement corresponding with the movement of the drive member shaft for engaging the frame in the secured position.

An object of the present invention is to provide a pawl assembly capable of restricting the passage of water, dust or other matter through the latch.

A further object of the present invention is to provide a pawl assembly which is durable in use and yet provides a smooth latching operation.

It is a still further object of the present invention to provide a pawl assembly in which the parts are few and which is relatively simple to install.

These and other objects of the present invention will become more readily apparent when taken into consideration with the following description and the attached drawings.

DETAILED DESCRIPTION OF THE PREFERRED EMBODIMENTS

Figure 1:
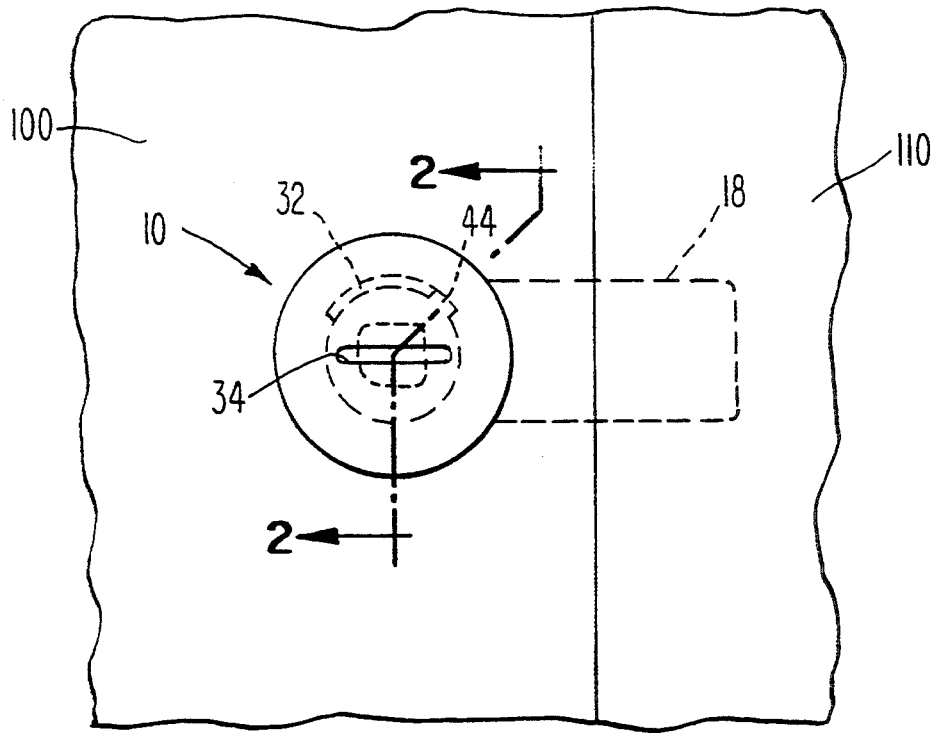
FIG. 1 is a perspective view, partly broken away, showing a door panel having a pawl assembly according to the present invention mounted therein.
Figure 2:
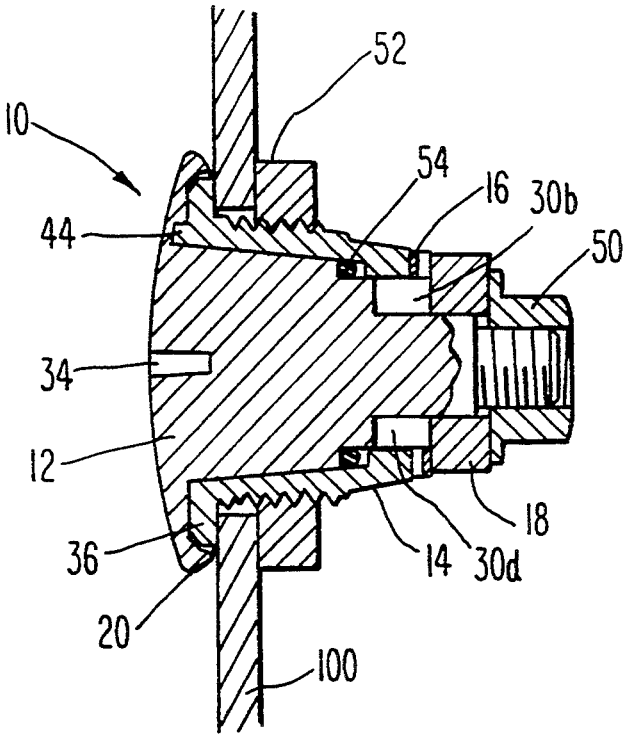
FIG. 2 is a sectional elevational view of the pawl assembly of FIG. 1 taken along the line of 2—2.
Figures 3, 4, 5, 6, 7:
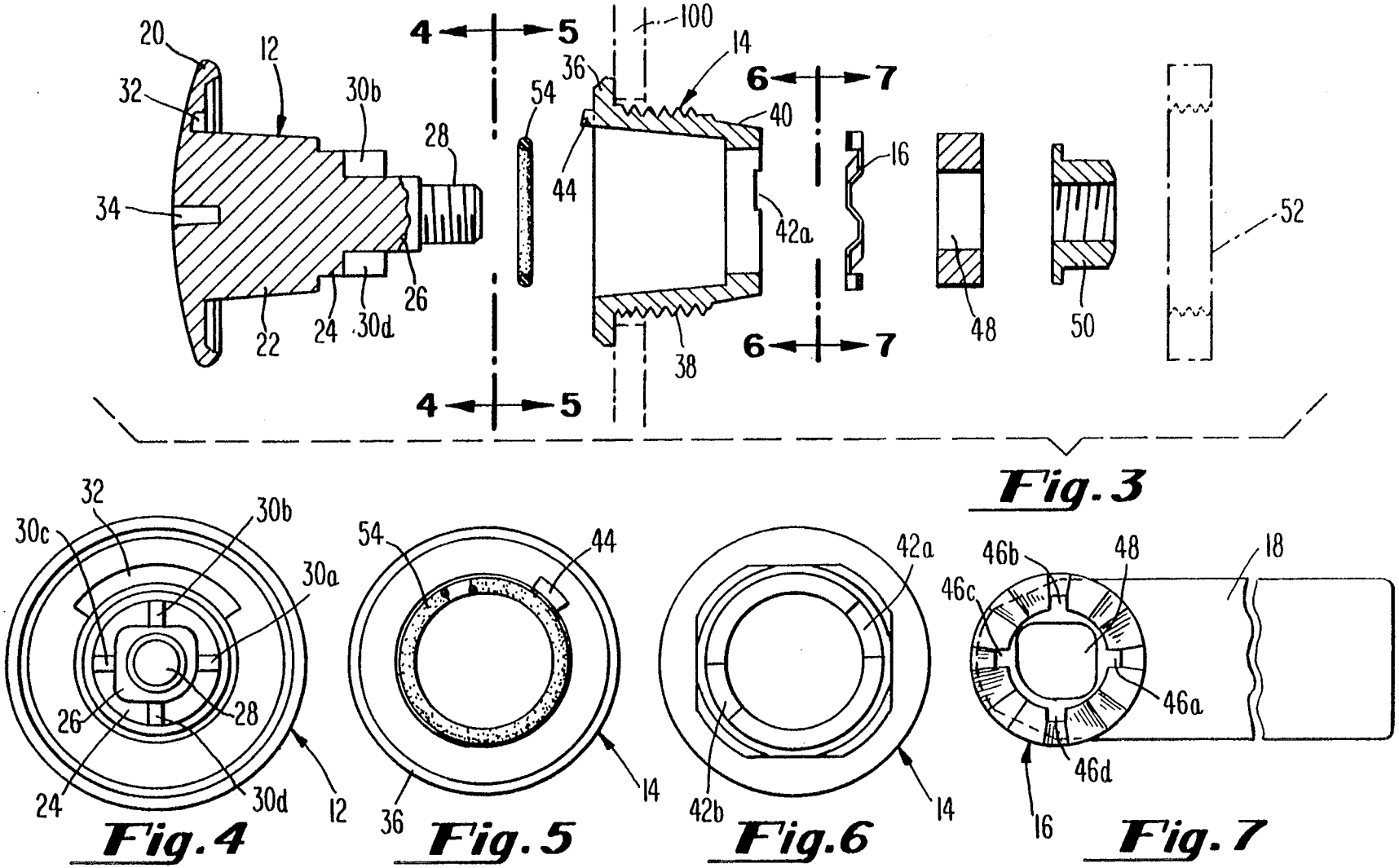
FIG. 3 is an exploded view of the pawl assembly shown in FIG. 2.
FIG. 4 is a plan view of the pawl assembly of FIG. 3 taken along the line 4—4.
FIG. 5 is a plan view of the pawl assembly of FIG. 3 taken along the line 5—5.
FIG. 6 is a plan view of the pawl assembly of FIG. 3 taken along the line 6—6.
FIG. 7 is a plan view of the pawl assembly of FIG. 3 taken along the line 7—7.

Referring now to the drawings in detail wherein like reference numerals indicate like elements throughout the several views, there is shown in FIG. 1, a perspective view, partly broken away, of a door panel 100 having a pawl assembly 10 according to the present invention mounted therein, and in a latched position engaging a cabinet frame 110. As most clearly illustrated in FIGS. 2 and 3, the major components of the pawl assembly 10 of the present invention are a drive member 12, a housing 14, a biasing means 16 and pawl means 18. FIG. 3 shows an exploded view of the pawl assembly 10 shown in FIG. 2; in FIG. 2 is illustrated a sectional elevational view of the pawl assembly of FIG. 1 taken along the line 2—2. The drive member 12 as shown preferably is a drive stud manufactured of die cast zinc with a variety of different finishes, however other materials can also be used for the same purpose. The drive member 12 as illustrated includes, as portions thereof, a drive flange 20 and a substantially elongated shaft extending inwardly therefrom. The substantially elongated shaft as shown includes a first portion 22, a second portion 24, a third portion 26 and a threaded fourth portion 28. The first portion 22 extends inwardly from the flange 20 and is comprised having a substantially circular cross-section. The second portion 24 extends inwardly from the first portion 22 and includes a substantially circular cross-section of a diameter less than the diameter of the first portion 22. The third portion 26 has a non-circular, generally irregular shaped cross-section which extends inwardly from the second portion 24. As best seen in the plan view of FIG. 4, taken along the line 4—4 of FIG. 3, the cross-section of the third portion 26 preferably includes a configuration which is generally rectangular with one substantially radiused corner. The threaded fourth portion 28 extends inwardly from the third portion 26 as shown. As seen illustrated in FIGS. 3 and 4, an at least one projecting member, preferably comprising the projecting members 30*a*–30*d*, are provided extending outwardly from a top surface of the second portion 24, and in engagement with a side surface of the third portion 26. The drive flange 20, as best illustrated in FIG. 4, is provided having a generally elongated channel 32 within its inner surface, preferably adjacent its first portion 22. In this illustrated embodiment, the drive member 12 is also included with an elongated slot 34 in its outer surface, which is adapted to receive a corresponding key member (not shown) for rotation of the drive member 12 during operation of the pawl assembly 10.

As best illustrated in FIG. 3 and the plan view of FIG. 5 taken along the line 5—5 of FIG. 3, the housing 14 includes therein a housing flange 36 which is adapted to abut the outer surface of the door panel 100 on installation. The housing flange 36 includes extending outwardly therefrom a protruding member 44 which is adapted to be received within the channel 32 of the drive member 12, as shown in FIG. 2. In addition, extending inwardly from the housing flange 36 is shown a threaded first area 38 and a substantially conical second area 40, adjacent the threaded first area 38. As best seen in the plan view of FIG. 6 taken along the line 6—6 of FIG. 3, the substantially conical third portion 40 includes therein at least one aperture formed within its inner side, preferably the two apertures 42*a* and 42*b* are provided formed therein for a purpose described below. Preferably, the housing 14 is manufactured of die cast zinc with chemical protective film, however other suitable materials can also be used for manufacture of this component.

As shown in FIG. 3, the biasing means 16 is a spring member of an irregular configuration, and comprises at least one but preferably a series of four alternating raised and lowered surfaces extending around the circumference thereof. The biasing means 16 also includes a substantially circular through hole therein. As best illustrated in the plan view of FIG. 7 taken along the line 7—7 of FIG. 3, the biasing means 16 further includes at least one receptacle formed therein, preferably the four receptacles 46*a*–46*d* are provided. The receptacles 46*a*–46*d* are adapted to be received by the projecting members 30*a*–30*d*, respectively, for fixing the position of the biasing means 16 relative to the drive member 12. In operation, the raised surfaces of the biasing means 16 are adapted to releasably engage the apertures 42*a*–42*b* of the housing 14 in the manner described below. Preferably, the biasing means 16 of the present invention is manufactured of hardened steel with a zinc alloy plate, however other suitable materials can also be provided.

The pawl means 18, as best seen in FIGS. 3 and 7, comprises a generally elongated pawl member which includes a through hole 48 formed therein. Preferably, the shape of through hole 48 corresponds in configuration with the configuration of the cross-section of third portion 26 of the drive member 12. As such, the pawl means 18 when the through hole 48 is properly aligned is receivable onto the third portion 26 of the drive member 12, as shown in FIGS. 2 and 7. In addition, the pawl means 18 includes a stepped section proximate its distal end (not shown) which extends toward the door panel 100 when mounted, and which engages the frame 110 in the latched position. The pawl means 18 preferably is manufactured of steel, with a zinc alloy plate, although other suitable materials can also be used for this purpose.

A fastening means such as a nut 50 is also included which is receivable onto the threaded fourth portion 28 of the drive member 12 for retaining the components of the pawl assembly 10 together as a unit.

As indicated earlier, the pawl assembly 10 of the present invention is adapted to be mounted in the door panel 100 for engaging the frame 110 in a closed position. Preferably, a mounting means such as a nut 52 is received onto the threaded first area 38 of housing 14 for mounting the pawl assembly 10 in the aperture of the door panel 100. The door panel 100 and frame 110 can be fabricated from any suitable type of material for enclosing various equipment or apparatus which may be installed therein (not shown). In the illustrated embodiment, the pawl assembly 10 is shown mounted in a door 100 for engaging a frame 110, however the pawl assembly 10 can have other applications as well, for example where two door panels engage in a closed position.

In operation of the pawl assembly 10, rotation of the drive member 12 causes a corresponding rotation of the pawl means 18 between an unlatched and latched position engaging the frame 110. In the present embodiment, the drive member 12 is shown having the elongated slot 34 formed therein, which is adapted to receive a correspondingly configured driving tool for rotation thereof. Although in the illustrated embodiment the elongated slot 34 is shown, other shapes can also be utilized for this same purpose, for example a square shape, star shape, triangular shape, etc. which would also be engageable by a corresponding tool. In certain other applications, a handle, knob or similar device can be secured directly onto the drive member 12 for rotation, rather than employing the separate driving tool, as illustrated in the present embodiment.

As best illustrated in FIGS. 1 and 4, the rotation of the pawl means 18 is limited by the position of the protruding member 44 in the substantially elongated channel 32. Specifically, the protruding member 44, when the pawl assembly 10 is in its fully latched position of FIG. 1, is in engagement with a first end of the channel 32. In its fully unlatched position, the protruding member 44 is rotated counterclockwise into engagement with the second end of the channel 32. Preferably, the pawl assembly 10 when fully unlatched is in a position 90° from the latched position. In the present embodiment, the arrangement of the protruding member 44 and channel 32 provide a 90° rotation of the pawl assembly 10. However, in other circumstances, if desired, the length of the elongated channel 32 can be varied to provide an alternate degree of rotation of the pawl assembly 10.

The pawl assembly of the present invention possesses several advantages over conventional pawl assemblies. A particular advantage is that the present invention is adapted to restrict the passage of water, dust or other matter through the latch and into the interior compartment of the door. As best shown in FIGS. 2 and 3, the drive flange 20 of the drive member 12 is preferably sized at least to completely cover the outer surface of the housing flange 36, which forms a seal for improving the sealability of the latch. An O-ring 54 can be provided adjacent the second portion 24 and abutting the first portion 22 of the drive member 12, and a sealing washer can be positioned proximate the underside of the drive flange 20 (not shown) in order to provide additional sealing of the pawl assembly 10. An additional benefit is that the larger sized flange also provides a broad bearing area which provides for a smoother latch operation.

Another advantage of the pawl assembly of the present invention is that the amount of stress imposed on the spring 16 is greatly reduced which will work to extend the operable life span of the device. As best illustrated in FIG. 3, the biasing means 16 is in a position between the housing 14 and pawl means 18 and in engagement with these two components. Due to this position between the housing 14 and pawl means 18, the biasing means 16 does not experience any of the load being applied by the latch, and therefore does not become overstressed, or possibly deformed in order to support that load. During operation, the biasing means 16 takes up any play in the latch which is oftentimes present due to manufacturing tolerances. Preferably, the biasing means 16 operates to force the components of the pawl assembly 10 together, which results in a frictional resistance upon the drive member 12 during rotation between the latched and unlatched positions. This arrangement provides for smoother operation of the pawl assembly 10 and greatly reduces the chance that the biasing means 16 will become permanently deformed during operation.

In addition, the present invention provides another advantage over the prior art in that the biasing means 16 also operates as a detent as the pawl means 18 is moved into its 90° latched and unlatched positions. As indicated earlier, the raised surfaces of the biasing means 16 are adapted to engage the apertures 42*a* and 42*b* formed in the bottom of the housing 12 in the latched and unlatched positions, thereby acting as a detent. Preferably, the four raised sections of the biasing means 16 are in an arrangement wherein two of the raised sections are diametrically opposing and engage the slots 42*a*–42*b* in the latched position, and the other two raised sections are diametrically opposing and engage slots 42*a*–42*b* in the unlatched position. This arrangement is particularly advantageous since the biasing means 16 is adapted for two operations; as a spring member for taking up additional play in the latch and as a detent when in the latched and unlatched positions of the pawl.

Furthermore, another advantage of the present pawl assembly over conventional pawl assemblies is that a quicker and easier installation can be accomplished without also requiring a more difficult and costly manufacturing process, or a reduction in the strength of the latch. Specifically, as indicated earlier, the through hole 48 of the pawl means 18 is shaped to coincide with the cross-sectional configuration of the third portion 26 of the drive member 12. This ensures that the pawl means 18 can only be installed properly onto the drive member 12 in one position of the pawl means 18. While in the present embodiment, the shape of the through hole 48 and third portion 26 of the drive member 12 are generally rectangular with a substantially radiused corner portion, any suitable shape or configuration can be utilized for the same purpose. As a result, it is the design of the pawl assembly 10 which dictates the proper orientation of the pawl means 18, rather than the installer of the latch.

In addition, in some instances, preferably in panels less than 6 mm thick, an assembled pawl assembly can be installed as a unit directly through the aperture of the door panel 100. This provides for a quicker installation procedure for the latch. Specifically, following installation of the pawl assembly 10 through the aperture of the door panel 100, the mounting nut 52 is received over the pawl means 18 and onto the housing 14 for mounting of the pawl assembly 10 in the aperture of the door panel 100. It is the conical portion 40 at the distal end of the housing 14 which allows the mounting nut 52 to be received from around the pawl means 18 and directly onto to the housing 14 for mounting of the pawl assembly 10.

It will be recognized by those skilled in the art that changes may be made by the above-described embodiments of the invention with departing from the broad inventive concepts thereof. For example, the apertures 42*a*–42*b* which are formed in the housing and the raised sections of the biasing means 16 can be comprised of any suitable configurations for this same purpose. In addition, the pawl means 18 can be formed having any suitable length or any suitable amount of offset in its stepped section without departing from the spirit of the invention. It is understood, therefore, that this invention is not limited to the particular embodiments disclosed, but it is intended to cover all modifications which are within the scope and spirit of the invention as defined by the appended claims.

We claim:

1. A pawl assembly adapted for mounting in an aperture formed in a door panel for releasably retaining the door against a corresponding frame, the pawl assembly comprising:

a housing adapted for being received within the aperture of the door panel and including extending therethrough a substantially axial bore;

a drive member including a substantially elongated shaft adapted for being received within the bore of the housing for rotational movement relative thereto;

a biasing means adapted for providing frictional resistance to the drive member upon rotational movement thereof;

means provided between the housing and the drive member adapted for preventing rotational movement of the drive member shaft past a predetermined amount of rotation thereof, wherein the means provided between the housing and the drive member for preventing rotational movement of the drive member shaft past a predetermined amount of rotation thereof comprises at least one protruding member adapted for being received within at least one substantially elongated channel, the substantially elongated channel including a first end and a second end therein, wherein the first end and the second end function as a stop of the protruding member adapted for limiting the rotational movement of the drive member shaft corresponding to the first and second ends of the substantially elongated channel, wherein the substantially elongated channel further includes a first wall and a generally opposing second wall at a spaced separation for connecting the first and the second end thereof, wherein the protruding member received with the substantially elongated channel is confined between the first wall and the second wall thereof; and pawl means associated with the drive member shaft adapted for rotational movement corresponding with the movement of the drive member shaft for engaging the frame in a secured position.

2. A pawl assembly according to claim 1, wherein the protruding member includes a front surface and a back surface in engagement with the first wall and the second wall of the substantially elongated channel, respectively, wherein a diameter of the protruding member between the front surface and the back surface thereof is sized corresponding to the spaced separation between the first and second walls of the substantially elongated channel.

3. A pawl assembly according to claim 2, wherein the substantially elongated channel further includes a bottom wall for connecting each of the first and second walls and the first and second ends thereof, wherein the protruding member further includes a top surface for connecting the front and back surfaces thereof and in engagement with the bottom wall of the substantially elongated channel.

4. A pawl assembly according to claim 3, wherein the drive member further includes a drive flange having an upper and a lower drive flange surface, with the lower drive flange surface having formed therein the substantially elongated channel, and wherein the housing includes a housing flange having an outer and an inner surface, with the outer surface of the housing flange having extending therefrom the protruding member, wherein the lower drive flange surface is in engagement with the outer surface of the housing at least adjacent the protruding member.

5. A pawl assembly according to claim 4, wherein the drive flange is in engagement with and sized at least to completely cover the outer surface of the housing flange, whereby the housing flange and drive flange form a seal for restricting the passage of matter through the pawl assembly.

6. A pawl assembly according to claim 4, wherein the biasing means is provided between the housing and the pawl means.

7. A pawl assembly according to claim 6, further comprising retaining means provided between the drive member and the biasing means adapted for fixing the position of the biasing means relative to the drive member.

8. A pawl assembly according to claim 6, further including detent means provided between the housing and the biasing means for releasably retaining the biasing means in at least one position of rotation relative to the housing upon rotation of the drive member.

9. A pawl assembly according to claim 4, wherein the pawl means comprises a generally elongated pawl member adapted for being received by the drive member shaft in only one orientation of the pawl member.

10. A pawl assembly according to claim 4, wherein the housing is generally conical in shape adjacent its end distal of the housing flange for receiving a mounting member, the mounting member being received onto the housing for securing the pawl assembly in the aperture of the door panel, whereby the mounting member upon installation thereof is slidable over the pawl means and onto the housing.

11. A pawl assembly adapted for mounting in an aperture formed in a door panel for releasably retaining the door against a corresponding frame, the pawl assembly comprising:

a housing adapted for being received within the aperture of the door panel and including extending therethrough a substantially axial bore, the housing further including a housing flange adapted for engaging an outer surface of the door panel when received therein, the housing flange comprising as portions thereof an outer and an inner surface with the inner surface being adapted for engaging the outer surface of the door panel;

a drive member including a substantially elongated shaft adapted for being received within the bore of the housing for rotational movement relative thereto, the drive member further including a drive flange in engagement with and sized at least to completely cover the outer surface of the housing flange, whereby the housing flange and drive flange form a seal for restricting the passage of matter through the pawl assembly and around the pawl assembly and through the panel aperture;

a biasing means adapted for providing frictional resistance to the drive member upon rotational movement thereof;

means for limiting the rotational movement of the drive member shaft; and pawl means associated with the drive member shaft adapted rotational movement corresponding with the movement of the drive member shaft for engaging the frame in a secured position.

12. A pawl assembly according to claim 11, wherein the drive flange includes an upper and a lower drive flange surface, with the lower drive flange surface having therein a cavity sufficiently configured to receive the housing flange for at least completely covering the outer surface thereof.

13. A pawl assembly according to claim 12, wherein the means for limiting the rotational movement of the drive member shaft comprises at least one protruding member extending outwardly from the housing adapted for being received within at least one substantially elongated channel formed within the drive member, the substantially elongated channel including a first end and a second end therein.

14. A pawl assembly according to claim 13, wherein the lower drive flange surface includes formed therein the substantially elongated channel, and wherein the outer surface of the housing flange includes extending therefrom the protruding member.

15. A pawl assembly according to claim 11, wherein the biasing means is provided between the housing and the pawl means.

16. A pawl assembly according to claim 15, further comprising retaining means provided between the drive member and the biasing means adapted for fixing the position of the biasing means relative to the drive member.

17. A pawl assembly according to claim 15, further including detent means provided between the housing and the biasing means for releasably retaining the biasing means in at least one position of rotation relative to the housing upon rotation of the drive member.

18. A pawl assembly according to claim 11, wherein the pawl means comprises a generally elongated pawl member adapted for being received by the drive member shaft in only one orientation of the pawl member.

19. A pawl assembly according to claim 11, wherein the housing is generally conical in shape adjacent its end distal of the housing flange for receiving a mounting member, the mounting member being received onto the housing for securing the pawl assembly in the aperture of the door panel, whereby the mounting member upon installation thereof is slidable over the pawl means and onto the housing.

20. A pawl assembly adapted for mounting in an aperture formed in a door panel for releasably retaining the door against a corresponding frame, the pawl assembly comprising:

a housing adapted for being received within the aperture of the door panel and including extending therethrough a substantially axial bore;

a drive member including a substantially elongated shaft adapted for being received within the bore of the housing for rotational movement relative thereto;

means for limiting the rotational movement of the drive member shaft;

pawl means associated with the drive member shaft adapted for rotational movement corresponding with the movement of the drive member shaft for engaging the frame in a secured position; and a biasing member provided between and in engagement with the housing and the pawl means adapted for providing frictional resistance to the drive member upon rotational movement thereof.

21. A pawl assembly according to claim 20, further including detent means provided between the housing and the biasing member for releasably retaining the biasing member in at least one position of rotation relative to the housing upon rotation of the drive member.

22. A pawl assembly according to claim 21, wherein the housing includes at least one aperture formed therein and the biasing member includes at least one raised section thereon adapted for releasably engaging the at least one aperture, whereby upon a first rotation of the drive member by an operator, the raised section of the biasing member will be moved to engage the aperture of the housing for retaining the biasing member and upon a second rotation of the drive member by an operator, the raised section of the biasing member will disengage the housing aperture for releasing the biasing member.

23. A pawl assembly according to claim 21, further comprising retaining means provided between the drive member and the biasing member adapted for fixing the position of the biasing member relative to the drive member.

24. A pawl assembly according to claim 23, wherein the retaining means comprises at least one projecting member extending outwardly from the drive member shaft adapted for receiving at least one receptacle formed in the biasing member.

25. A pawl assembly according to claim 23, wherein the means for limiting the rotational movement of the drive member shaft comprises at least one protruding member extending outwardly from the housing adapted for being received within at least one substantially elongated channel formed within the drive member, the substantially elongated channel including a first end and a second end therein.

26. A pawl assembly according to claim 25, wherein the housing includes at least two apertures formed therein and the biasing member includes at least two raised sections thereon adapted for releasably engaging the biasing member in at least two positions of rotation relative to the housing, the first position corresponding to the first end of the channel and the second position corresponding to the second end of the channel, wherein the two raised sections of the biasing member are positioned spaced apart a distance corresponding to the first and second ends of the channel, and the two apertures of the housing are positioned spaced apart a distance corresponding with the two raised sections of the biasing member and the first and second ends of the channel.

27. A pawl assembly according to claim 23, wherein the housing includes a housing flange adapted for engaging an outer surface of the door panel when received therein, the housing flange including as portions thereof an outer and an inner surface, the drive member further including a drive flange in engagement with and sized at least to completely cover the outer surface of the housing flange, whereby the housing flange and drive flange form a seal for restricting the passage of matter through the pawl assembly.

28. A pawl assembly according to claim 23, wherein the pawl means comprises a generally elongated pawl member adapted for being received by the drive member shaft in only one orientation of the pawl member.

29. A pawl assembly according to claim 23, wherein the housing is generally conical in shape adjacent its distal end for receiving a mounting member, the mounting member being received onto the housing for securing the pawl assembly in the aperture of the door panel, whereby the mounting member upon installation thereof is slidable over the pawl means and onto the housing.

30. A pawl assembly according to claim 20, wherein the biasing member includes at least one generally radiused section thereon extending between the housing and the pawl means for providing the frictional resistance to the drive member upon rotation thereof.

31. A pawl assembly adapted for mounting in an aperture formed in a door panel for releasably retaining the door against a corresponding frame, the pawl assembly comprising:

a housing adapted for being received within the aperture of the door panel, the housing including extending therethrough a substantially axial bore;

a drive member including a substantially elongated shaft adapted for being received within the bore of the housing for rotational movement relative thereto;

a biasing means adapted for providing frictional resistance to the drive member upon rotational movement thereof;

means for limiting the rotational movement of the drive member shaft; and pawl means including a first surface and a second surface mounted with the drive member shaft adapted for rotational movement corresponding with the movement of the drive member shaft for engaging the frame in a secured position, the pawl means further comprising attachment means for permitting mounting of the pawl means with the drive member shaft in only one orientation and one plane of the pawl means relative to the drive member shaft whereby the first surface is closer to the drive member than the second surface.

32. A pawl assembly according to claim 31, wherein the pawl means comprises a generally elongated pawl member, and the attachment means comprises at least one portion of the drive member shaft having a non-symmetrically shaped cross-section, and the pawl member includes therein a through hole formed corresponding in configuration with the cross-section of the at least one portion of the drive member shaft, wherein the configuration of the at least one portion of the drive member shaft and through hole of the pawl member permit engagement thereof in only one orientation and one plane of the pawl member relative to the drive member shaft.

33. A pawl assembly according to claim 32, wherein the non-symmetrically shaped cross-section of the at least one portion of the drive member shaft is substantially rectangular with a corner thereof having a radius generally larger than another corner thereof.

34. A pawl assembly according to claim 32, wherein the means for limiting the rotational movement of the drive member shaft comprises at least one protruding member extending outwardly from the housing adapted for being received within at least one substantially elongated channel formed within the drive member, the substantially elongated channel including a first end and a second end therein.

35. A pawl assembly according to claim 32, wherein the housing includes a housing flange adapted for engaging an outer surface of the door panel when received therein, the housing flange including as portions thereof an outer and an inner surface, the drive member further including a drive flange in engagement with and sized at least to completely cover the outer surface of the housing flange, whereby the housing flange and drive flange form a seal for restricting the passage of matter through the pawl assembly.

36. A pawl assembly according to claim 32, wherein the biasing means is provided between the housing and the pawl means.

37. A pawl assembly according to claim 36, further comprising retaining means provided between the drive member and the biasing means adapted for fixing the position of the biasing means relative to the drive member.

38. A pawl assembly according to claim 36, further including detent means provided between the housing and the biasing means for releasably retaining the biasing means in at least one position of rotation relative to the housing upon rotation of the drive member.

39. A pawl assembly according to claim 32, wherein the housing is generally conical in shape adjacent its distal end for receiving a mounting member, the mounting member being received onto the housing for securing the pawl assembly in the aperture of the door panel, whereby the mounting member upon installation thereof is slidable over the pawl means and onto the housing.

40. A pawl assembly adapted for mounting in an aperture formed in a door panel for releasably retaining the door against a corresponding frame, the pawl assembly comprising:

a housing adapted for being received within the aperture of the door panel, the housing including extending therethrough a substantially axial bore;

a drive member including a substantially elongated shaft adapted for being received within the bore of the housing for rotational movement relative thereto;

a biasing means adapted for providing frictional resistance to the drive member upon rotational movement thereof;

means for limiting the rotational movement of the drive member shaft;

pawl means comprising a generally elongate pawl member associated with the drive member shaft adapted for rotational movement corresponding with the movement of the drive member shaft for engaging the frame in a secured position; and a mounting member having a cavity therein adapted for being received onto the housing for securing the pawl assembly in the aperture of the door panel;

the pawl assembly further including means for mounting an assembled pawl assembly in the aperture of the door panel, wherein the mounting means includes means for installing the pawl assembly when assembled in the aperture of the door panel, with the assembled pawl assembly including in combination the housing, the drive member, the biasing means, the limiting means and the pawl means, wherein on installation the generally elongate pawl member comprising the pawl means is first passed through the aperture of the door panel, with the housing then being receivable within the door panel aperture for mounting therein, the mounting means further including means for securing the assembled pawl assembly when installed in the aperture of the door panel by the mounting member, with the mounting member via the cavity thereof being receivable onto the distal end of the generally elongate pawl member and then slidable thereover and onto the housing for securing the pawl assembly within the aperture of the door panel.

41. A pawl assembly according to claim 40, wherein the mounting means includes at least one outer surface area of reduced diameter of the housing adjacent the distal end thereof sufficiently configured for allowing installation of the housing and securing of the pawl assembly by the mounting member.

42. A pawl assembly according to claim 40, wherein the means for limiting the rotational movement of the drive member shaft comprises at least one protruding member extending outwardly from the housing adapted for being received within at least one substantially elongated channel formed within the drive member, the substantially elongated channel including a first end and a second end therein.

43. A pawl assembly according to claim 40, wherein the housing includes a housing flange adapted for engaging an outer surface of the door panel when received therein, the housing flange including as portions thereof an outer and an inner surface, the drive member further including a drive flange in engagement with and sized at least to completely cover the outer surface of the housing flange, whereby the housing flange and drive flange form a seal for restricting the passage of matter through the pawl assembly.

44. A pawl assembly according to claim 40, wherein the biasing means is provided between the housing and the pawl means.

45. A pawl assembly according to claim 44, further comprising retaining means provided between the drive member and the biasing means adapted for fixing the position of the biasing means relative to the drive member.

46. A pawl assembly according to claim 44, further including detent means provided between the housing and the biasing means for releasably retaining the biasing means in at least one position of rotation relative to the housing upon rotation of the drive member.

47. A pawl assembly according to claim 40, wherein the pawl member is adapted for being received by the drive member shaft in only one orientation of the pawl member.

48. A pawl assembly adapted for mounting in an aperture formed in a door panel for releasably retaining the door against a corresponding frame, the pawl assembly comprising:

a housing adapted for being received within the aperture of the door panel and including extending therethrough a substantially axial bore, the housing further including a housing flange adapted for engaging an outer surface of the door panel when received therein, the housing flange comprising as portions thereof an outer and an inner surface, with the inner surface being adapted for engaging the outer surface of the door panel;

a drive member including a substantially elongated shaft adapted for being received within the bore of the housing for rotational movement relative thereto, the drive member further including a drive flange in engagement with and sized at least to completely cover the outer surface of the housing flange, wherein the drive flange includes an upper and a lower drive flange surface, with the lower drive flange surface having therein a cavity sufficiently configured to receive the housing flange for at least completely covering the outer surface thereof, whereby the housing flange and drive flange form a seal for restricting the passage of matter through the pawl assembly and around the pawl assembly and through the panel aperture;

means provided between the housing and the drive member adapted for preventing rotational movement of the drive member shaft past a predetermined amount of rotation thereof, wherein the means provided between the housing and the drive member for preventing rotational movement of the drive member shaft past a predetermined amount of rotation thereof comprises at least one protruding member adapted for being received within at least one substantially elongated channel, the substantially elongated channel including a first end and a second end therein, wherein the first end and the second end function as a stop of the protruding member adapted for limiting the rotational movement of the drive member shaft corresponding to the first and second ends of the substantially elongated channel, wherein the substantially elongated channel further includes a first wall and a generally opposing second wall at a spaced separation for connecting the first and the second end thereof, wherein the protruding member received with the substantially elongated channel is confined between the first wall and the second wall thereof;

pawl means mounted with the drive member shaft adapted for rotational movement corresponding with the movement of the drive shaft for engaging the frame in a secured position, the pawl means comprising a generally elongated pawl member and including attachment means for permitting mounting of the pawl member with the drive member shaft in only one orientation and one plane of the pawl member relative to the drive member shaft;

a biasing member provided between and in engagement with the housing and the pawl means adapted for providing frictional resistance to the drive member upon rotational movement thereof, wherein the biasing member includes at least one generally radiused section therein extending between the housing and the pawl means for providing the frictional resistance to the drive member upon rotation thereof;

the biasing member further including detent means provided between the housing and the biasing member for releasably retaining the biasing member in at least one position of rotation relative to the housing upon rotation of the drive member; and a mounting member having a cavity therein adapted for being received onto the housing for securing the pawl assembly in the aperture of the door panel;

the pawl assembly further including means for mounting an assembled pawl assembly in the aperture of the door panel, wherein the mounting means includes means for installing the panel assembly when assembled in the aperture of the door panel, with the assembled pawl assembly including in combination the housing, the drive member, the biasing means, the limiting means and the pawl means, wherein on installation the generally elongate pawl member comprising the pawl means is first passed through the aperture of the door panel, with the housing then being receivable within the door panel aperture for mounting therein, the mounting means further including means for securing the assembled pawl assembly when installed in the aperture of the door panel by the mounting member, with the mounting member via the cavity thereof being receivable onto the distal end of the generally elongate pawl member and then slidable thereover and onto the housing for securing the pawl assembly within the aperture of the door panel, wherein the mounting means includes at least one outer surface area of reduced diameter of the housing adjacent the distal end thereof sufficiently configured for allowing installation of the housing and securing of the pawl assembly by the mounting member.

49. A pawl assembly according to claim 48, further comprising retaining means provided between the drive member and the biasing means adapted for fixing the position of the biasing means relative to the drive member.

50. A pawl assembly according to claim 48, wherein the housing includes at least one aperture formed therein and the biasing means includes at least one raised section thereon adapted for releasably engaging the at least one aperture, whereby upon a first rotation of the drive member by an operator, the raised section of the biasing means will be moved to engage the aperture of the housing for retaining the biasing means, and upon a second rotation of the drive member by an operator, the raised section of the biasing means will disengage the housing aperture for releasing the biasing means.

51. A pawl assembly according to claim 48, wherein the pawl means comprises a generally elongated pawl member, and the attachment means comprises at least one portion of the drive member shaft having a non-symmetrically shaped cross-section, and the pawl member includes therein a through hole formed corresponding in configuration with the cross-section of the at least one portion of the drive member shaft, wherein the configuration of the at least one portion of the drive member shaft and through hole of the pawl member permit engagement thereof in only one orientation and one plane of the pawl member relative to the drive member shaft.

* * * * *